United States Patent [19]

Gilliom

[11] Patent Number: 4,793,667

[45] Date of Patent: Dec. 27, 1988

[54] KNOCKDOWN STEEL COUNTER

[75] Inventor: John W. Gilliom, Conway, Ark.

[73] Assignee: White Consolidated Industries, Inc., Cleveland, Ohio

[21] Appl. No.: 159,478

[22] Filed: Feb. 19, 1988

Related U.S. Application Data

[63] Continuation of Ser. No. 36,440, Apr. 9, 1987, abandoned.

[51] Int. Cl.[4] ..... A47B 48/00

[52] U.S. Cl. ..... 312/263; 312/108; 312/264

[58] Field of Search ..... 312/257 R, 263, 257 SK, 312/257 SM, 264, 108, 140

[56] References Cited

U.S. PATENT DOCUMENTS

| | | | |
|---|---|---|---|
| 1,944,687 | 1/1934 | Henderson | 312/257 R X |
| 3,399,941 | 9/1968 | Hansen et al. | 312/257 R |
| 4,191,029 | 3/1980 | Dunne | 312/257 SK X |
| 4,288,132 | 9/1981 | Znamirowski et al. | 312/257 SM |
| 4,462,647 | 7/1984 | Key | 312/257 R |

FOREIGN PATENT DOCUMENTS

| | | | |
|---|---|---|---|
| 241821 | 8/1962 | Australia | 312/257 R |
| 2609100 | 9/1977 | Fed. Rep. of Germany | 312/257 SK |
| 402315 | 4/1963 | Switzerland | 312/257 R |

*Primary Examiner*—Joseph Falk

*Attorney, Agent, or Firm*—Pearne, Gordon, McCoy & Granger

[57] ABSTRACT

A knockdown metal cabinet is particularly suited for the food merchandising business and can be quickly assembled from a plurality of flat panels. A rectangular base member has upstanding brackets at each corner along front and back sides which receive channel members secured to a pair of opposed side panels. The side panels are joined together at the top by a pair of horizontal braces each secured at two vertically spaced points to the adjacent side panel to produce a rigid box structure. Front and back panels are then hung in place and supported by the horizontal braces and the base without fasteners. The assembly may then be completed by a top member which is secured to horizontal flanges extending along the top edges of each of the side panels.

7 Claims, 5 Drawing Sheets

KNOCKDOWN STEEL COUNTER

This is a continuation, division, of application Ser. No. 036,440, filed on Apr. 9, 1988 now abandoned.

BACKGROUND OF THE INVENTION

This invention relates generally to metal cabinets, and more particularly to sheet metal cabinets of the knockdown-type for use in food merchandising.

One area of rapid growth in food merchandising is in fast-food systems of the type that are used in convenience stores, gasoline stations, and other similar locations for the sale of snacks, sandwiches, hot and cold drinks, and frozen desserts. These fast-food installations require counter units incorporating storage cabinets and shelving, both as work space and for storing items and displaying them for purchase. These counters are preferably modular in concept so they can fit a number of different sized areas in different numbers, and can combine with cold storage cabinets, microwave heating units, and various dispensing equipment in a compact, functional arrangement. This type of equipment must also be capable of quick assembly so that installation of a unit can be completed in a minimum amount of time to place it in an operating condition. Furthermore, the counter units in particular must lend themselves to shipping in a knockdown or disassembled condition to minimize shipping space and yet be easily assembled to reduce the finished product using unskilled labor in a minimum of time.

Counters of this type must have a high degree of ruggedness and strength under heavy usage conditions, and also must have a construction and finish to allow easy cleaning to maintain the necessary sanitary conditions required by law. While many installations will have wall surfaces extending into contact with the floor, other applications may require the cabinets to be raised a short distance on legs to allow ready cleaning of the floor area underneath the cabinets and counters.

Heretofore, many such cabinets have been made from various wood materials with special finishes for easy cleaning and scratch resistance, or sometimes wood and metal composites, to allow additional strength and durability provided by the use of steel structural members. However, such cabinets tend to be difficult to assemble in the field, and sometimes may lend themselves to errors in assembly which complicate and lengthen the assembly time, and sometimes even damage the cabinets themselves.

SUMMARY OF THE INVENTION

The present invention provides a knockdown-type sheet steel cabinet whose component parts can be shipped in a relatively small, dense package to minimize shipping costs. These parts can readily be assembled into a completed cabinet in a minimum time by unskilled workers without welding, and using a minimum number of fasteners.

The completed cabinet structure is very rigid and, depending upon the selection of parts, may be made into modular side-by-side units connected together by a common partition. The front of the cabinet is preferably fitted with a pair of vertically hinged doors and the interior has provisions for mounting shelves at varying heights. Furthermore, the upper structure can be used either as a plain counter or for mounting additional units such as cup dispensers or additional shelving, as desired.

According to the preferred embodiment of the invention, the cabinet structure includes a flat, rectangular base having downturned sides, and reinforcing members are fastened to the underside along each side which provide for the threaded mounting of legs, if such are desired. At each corner along the front and back edges, upwardly projecting bracket members are mounted, each by a single screw. A pair of side panels are formed to have on the inturned front and rear edges a closed channel in which the sheet metal is formed by successive bends to fit entirely around and telescopically receive the upwardly extending bracket members. One or more screw-type fasteners can then be used on the inside portions of these channels to secure the side members to the brackets, and hence to the base.

To provide rigidity at the upper end, a pair of horizontal braces, one each for the front and rear, interconnect the opposed upper corners of the side panels. For quick assembly, each of these horizontal braces has, at each end, a pair of vertically aligned keyhole slots adapted to fit over headed buttons or rivets secured to the inside of the channel portion of each side panel. When these braces are in place, by virtue of the two points of attachment, they form a rigid box with the side panels and the base. The rear panel is then assembled from the top to have projecting side flanges which fit on the inside of the channels of the side panels, and at the lower end a folded flange which then rests on the upper surface of the base member and is continued into a downwardly extending flange to lock the rear panel against inward movement as the side flanges prevent outward movement. At the top, the rear panel has an open channel formed with a horizontal and vertical extension to fit over the horizontal brace to lock the members together so that the panel is supported at the top on the horizontal brace and on the base at the bottom.

The front panel is attached in a different manner, and includes open channel portions formed on the top and bottom edges. These channel portions are so formed that when the bottom channel hooks under the downturned side on the base, the front panel may be raised sufficiently to hook the upper channel over the front brace, and when the front panel is then lowered so that the upper channel rests on the top surface of the horizontal brace, the bottom channel is still in engagement with the flange on the base, so that the front panel remains locked in place. The top may then be mounted directly on this structure and held in place by screws passing through inturned flanges along the top edges of the side panels and into the top, to result in a rigid, completely enclosed structure, with the doors being mounted on the front panel in a conventional manner.

It is possible to combine two or more units together in a rigid structure by utilizing two identical bases and using a center divider having channels on both sides of the panel. When the center divider is attached to two adjacent bases, each of the channels goes over a bracket on an adjacent base to firmly lock the bases together, and the assembly may be completed by the use of a single top panel spanning both of the cabinet units.

DETAILED DESCRIPTION OF THE INVENTION

Figure 1:
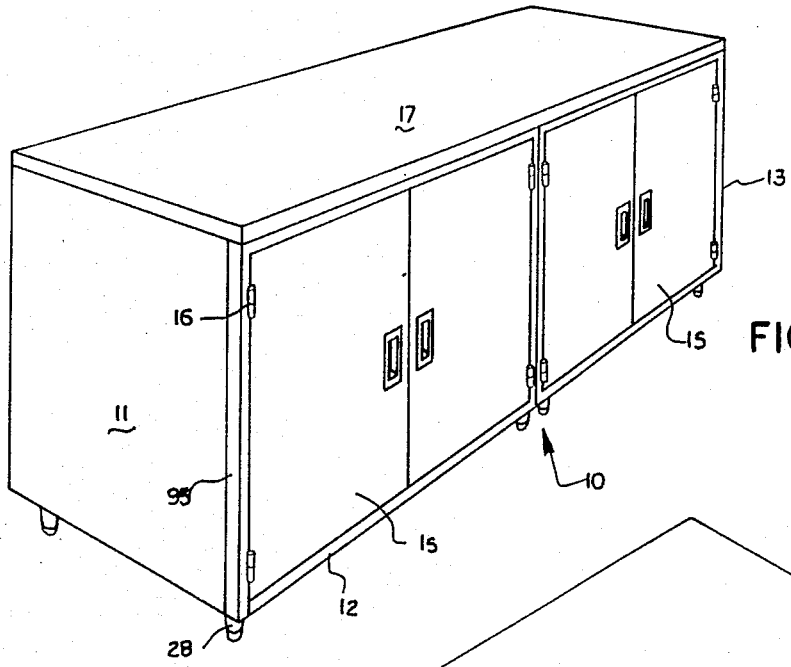
FIG. 1 is a perspective view of a knockdown counter unit fully assembled from two modular units.

Referring to the drawings in greater detail, FIG. 1 shows a double cabinet unit 10 whose construction will be discussed in greater detail hereinafter. The unit is closed by an end or side panel 11 on each side and has left and right front panels 12 and 13, each of which is provided by a pair of swinging doors 15 mounted on hinges 16. A single top 17 extends across both of the units and assists in connecting them together as a single unit.

Figure 2:
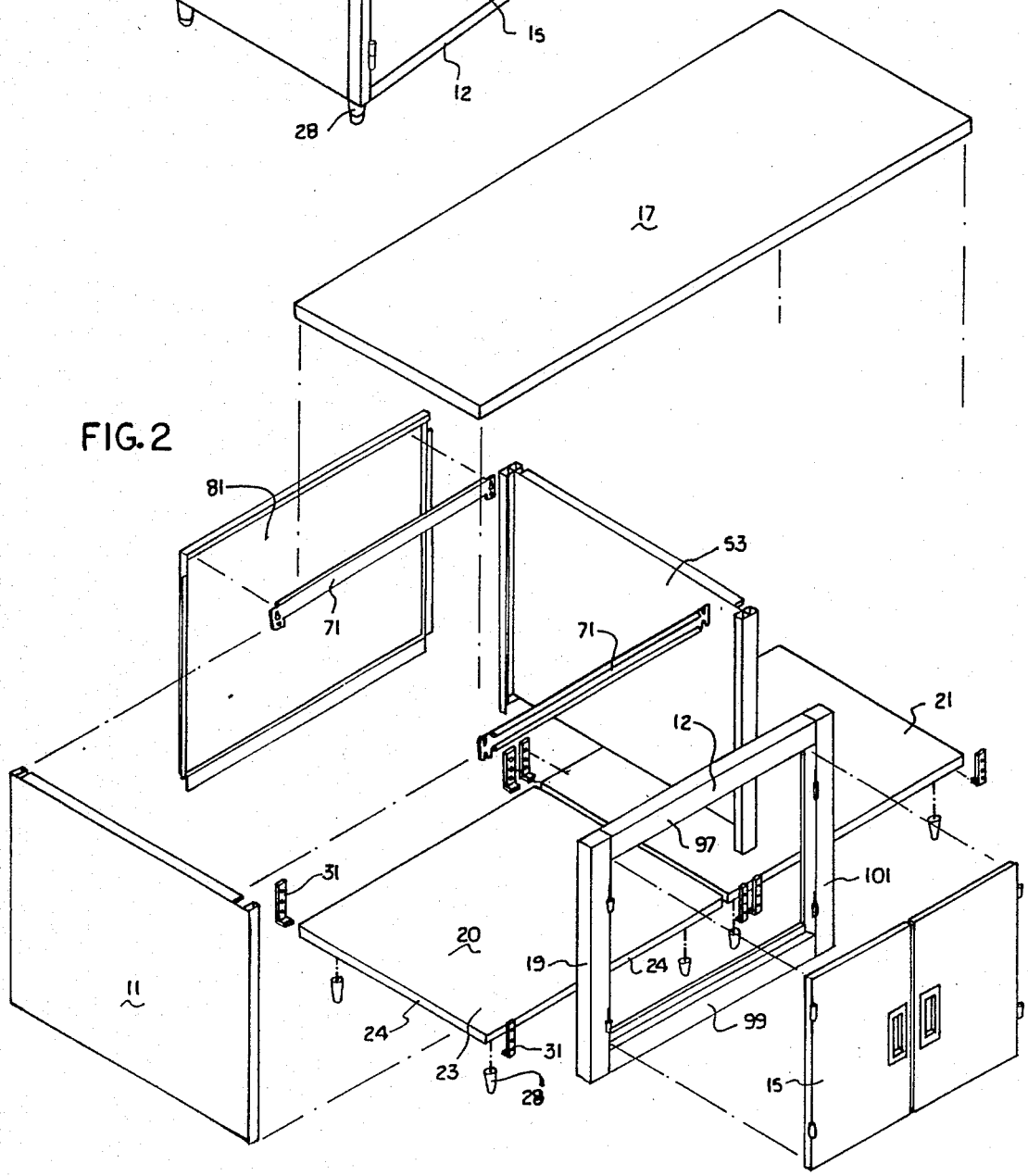
FIG. 2 is an exploded view of the unit shown in FIG. 1, with similar components of the second unit eliminated for clarity.
Figure 3:
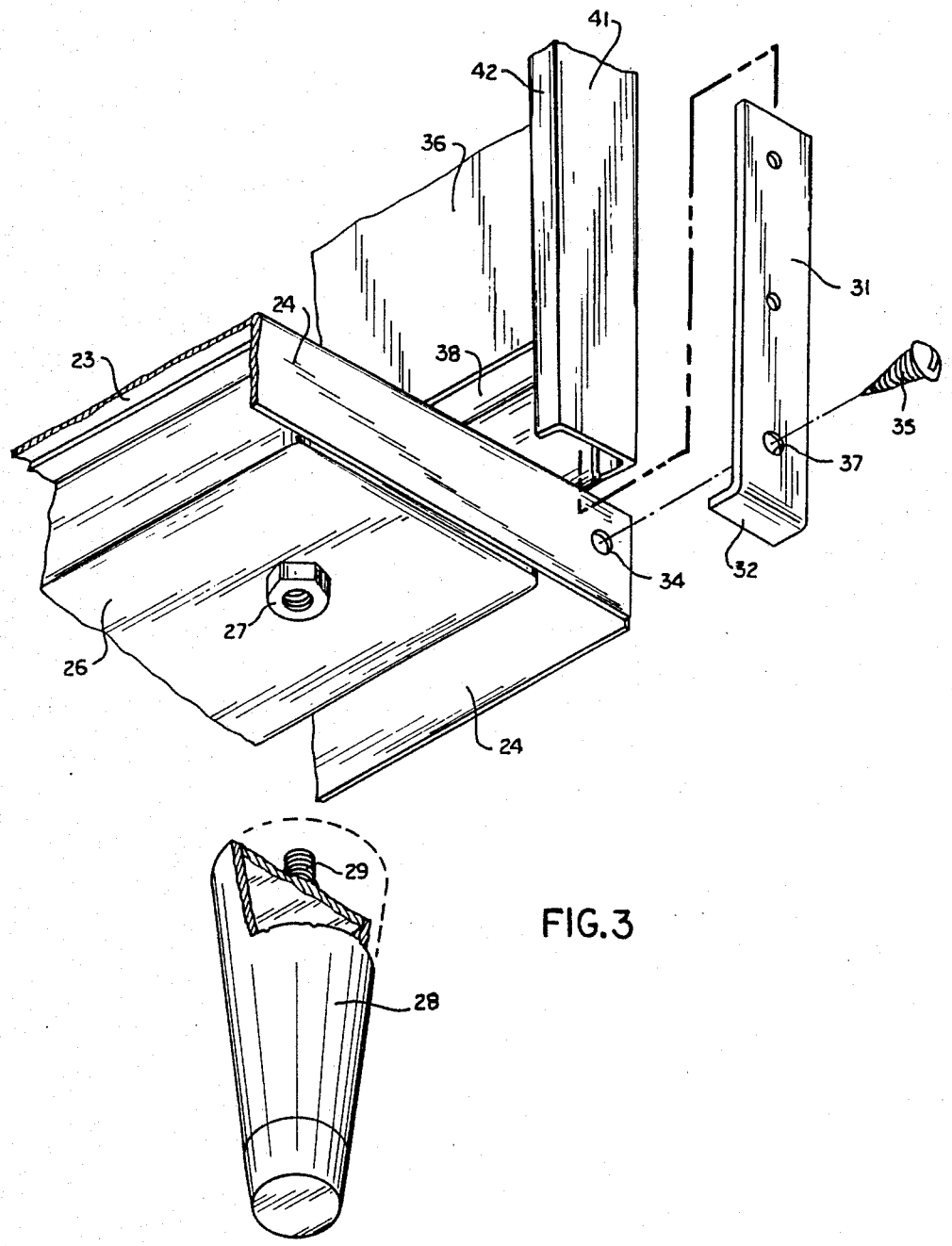
FIG. 3 is an exploded, perspective view as seen from the bottom of an outside corner portion of a unit.

As shown in FIG. 2, the entire assembly consists of left and right base units 20 and 21 which are identical in construction, so only a single unit will be described in greater detail. Thus, the base unit 20 includes a central panel section 23 formed from sheet steel, and which has an integral, downwardly extending flange 24 on each of the four sides. On its underside, the base has a pair of channels 26 (see FIG. 3) in the form of a hat-section which are welded to the underside for stiffness. Each of the channels 26 is spaced slightly inward from the sides, and runs the full distance from the front to the back flanges. At each of the corners, the channel 26 is provided with a weld nut 27 into which is threaded a stud 29 on the leg 28. These legs may be of conventional, commercially available construction, and merely serve to elevate the units a spaced distance above the floor for cleaning purposes. Of course, if desired, the legs may be eliminated or a base of other construction used.

In order to mount the side panels and the rest of the cabinet on the base, an upstanding bracket 31 is secured at each corner to the front and rear faces of the base. Each of the brackets 31 is formed from heavy sheet steel and has an inturned flange 32 at the lower end. This flange 32 fits snugly underneath the base flange 24, and, using aligned holes 33 and 34 in the bracket 31 and flange 24, respectively, a suitable screw and nut or other fastener can be used to rigidly hold the bracket in place.

Figure 4:
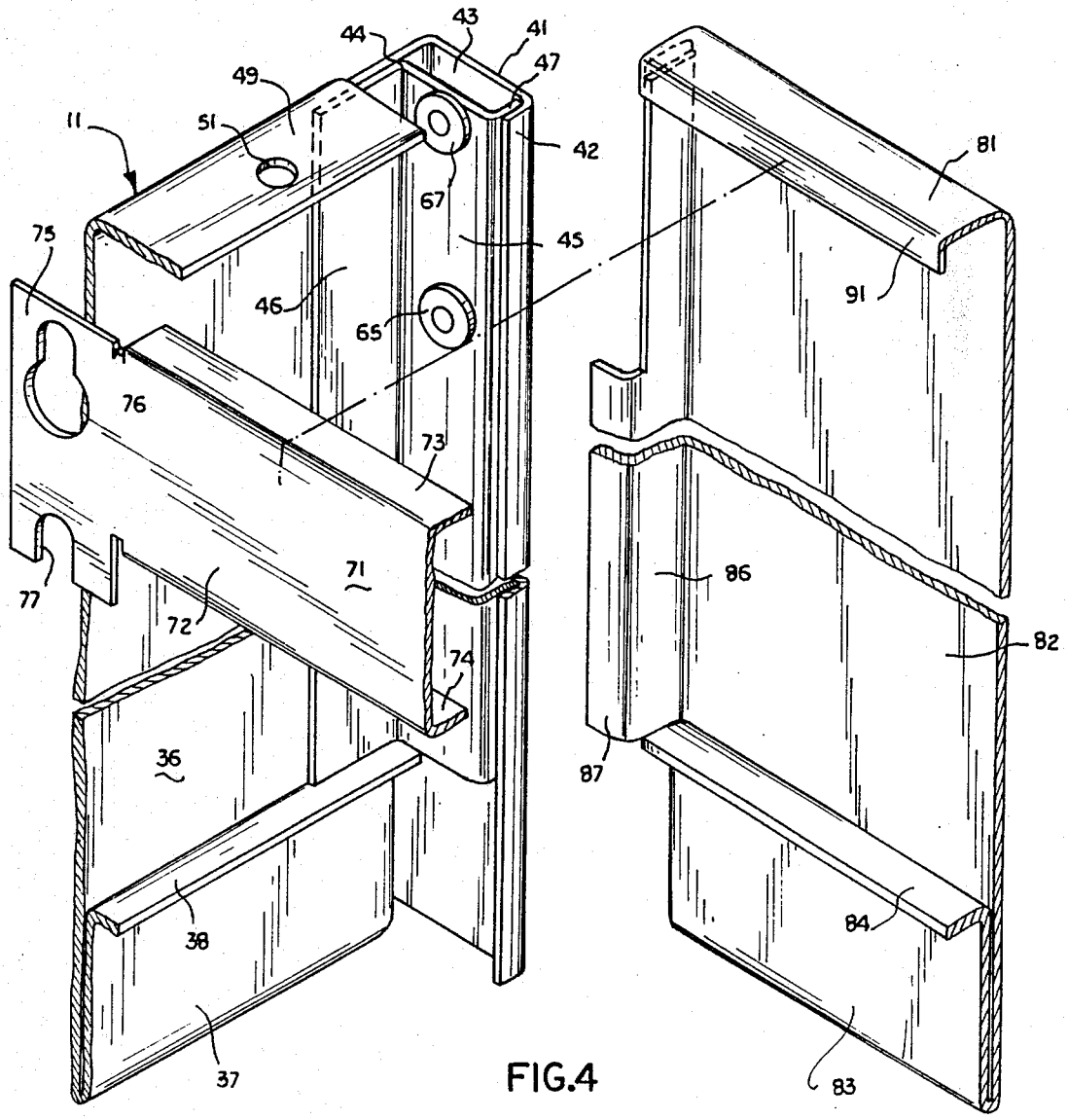
FIG. 4 is an exploded, perspective view of an upper, rear outside corner showing the side and rear panels.

The end panel 11 has a central panel portion 36 which, at its lower end, is formed into a folded lower edge 37 which extends upward for a height substantially equal to the height of the base flange 24, where it terminates in an inturned lip 38 adapted to abut the top of the base when the panel is in position. Along the front and back vertical sides of panel 11 is a return or C-flange 41 in which the center section has a width slightly greater than the width of the bracket 11, and a return lip 42 extending back parallel to the center section 36. A Z-bar 44 is fitted within the return flange 41 and has a web 45 extending parallel with the center section 43. A long flange 46 extends along the panel center section 36, and is spot-welded to it. The short flange 47 extends inside of the lip 42 and is also spot-welded to it. The Z-bar 44 extends to the upper edge of the return flange 41, but terminates a short distance above the lip 38, as shown in greater detail in FIG. 4. Along its upper edge, the center portion 36 is formed into a top flange 49 having holes therein to receive screws which engage the top 17 to firmly secure it to the end panels.

Figure 5:
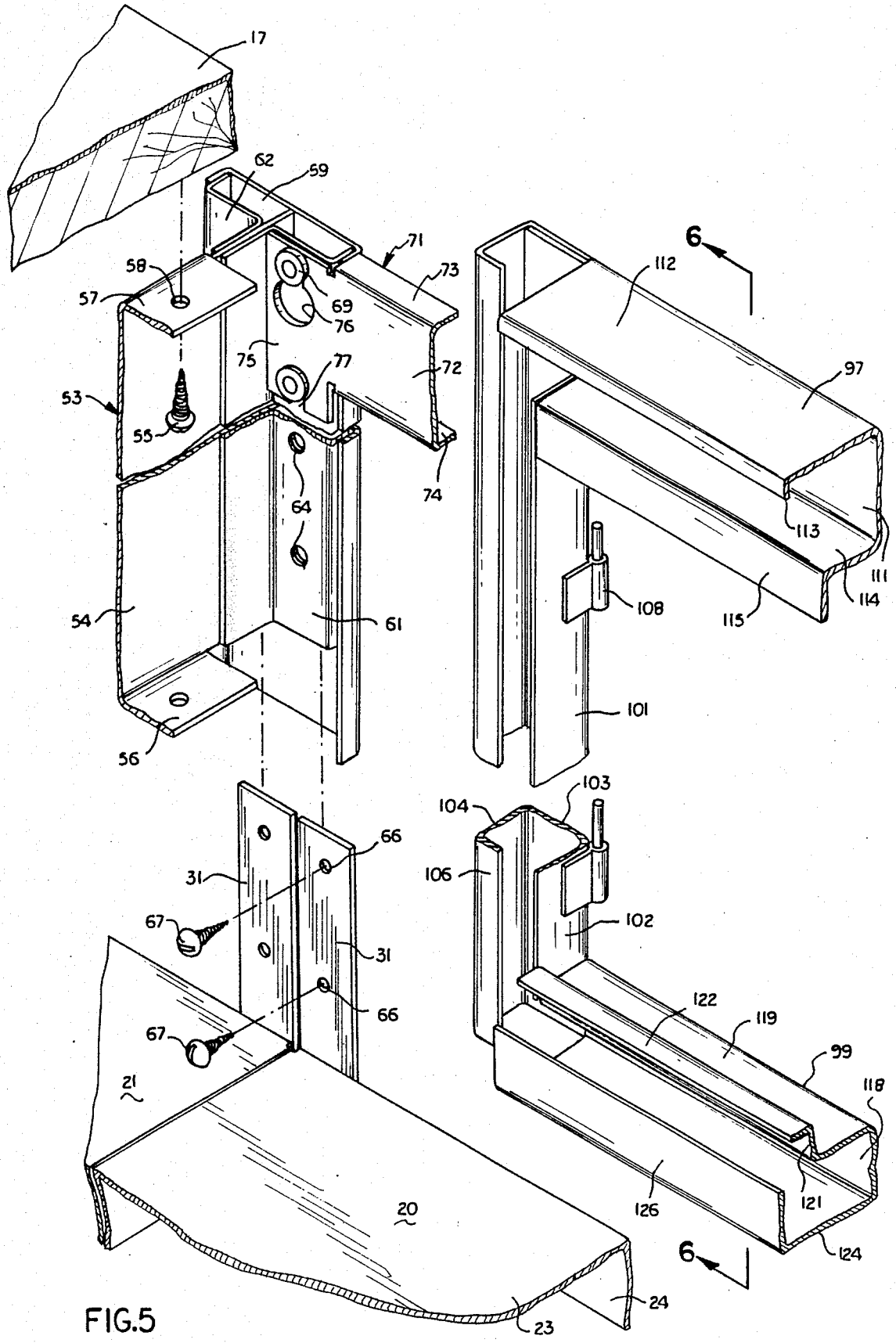
FIG. 5 is an exploded view from the inside, showing the front panel and center divider panel joining two base units.

As shown in FIGS. 2 and 5, when a pair of base members such as bases 20 and 21 are to be joined together as a single unit, a single center panel 53 is substituted for what would otherwise be a pair of adjacent end panels. Center panel 53 is very similar in construction to the end panels, except for the modifications allowing it to be mounted on brackets 31 of the adjoining base panels. The center panel 53 includes a center panel section 54 which, at its bottom end, terminates in a plain flange 56, which, when the panel is in position, rests against the upper surface of one of the bases. Along the top surface, the center section 54 has an integral top flange 57 which may be provided with holes 58 to receive screws 55 for holding the top 17 in place. To provide for the mounting on the brackets 31, the center panel 53 uses an inturned outer channel 59 extending from the top down to a point in alignment with the lower edge of the base flange 24 to cover the screw 35 used to hold the bracket to the base. A pair of Z-bars 61 and 62 are arranged similar to the Z-bar 44, so as to fit within the outer channel 59 with the short flange and have the long flange secured to the center section 54 by suitable means such as spot welding. Thus, when the center panel 53 is mounted in place, the adjacent brackets 31 of the two bases fit within the channel portions defined by the outer channel 59 and the Z-bars 61 and 62 to hold the two base panels together as a unit. Thus at the lower end, the Z-bars have a pair of holes 64 which align with holes 66 in the bracket 31 and receive self-tapping screws 67 to secure the brackets directly to the Z-bars.

Since the end panels and/or center panel 53 are rigidly secured to the base, they in themselves form a fairly rigid structure. However, the rigidity is completed by the use of cross-bars 71 at both the front and back, which serves to connect together the panels at the upper end. The cross-bar 71 is the same for the front and back, and includes a vertical center wall 72 from which extend top and bottom flanges 73, 74, respectively, in an outward direction on both the front and the back. The cross-bar 71 has a flat end portion 75 having a keyhole slot 76 at the upper side and a U-slot 77 vertically below it a spaced distance. At each of the upper corners, on the inside web of the adjacent Z-bar, on both the end and center panels are rigidly mounted headed studs 69. The cross-bars 71 are assembled by placing the lower end of the keyhole slot 76 over the upper stud 69, and then pressing down so that the upper end of the slot 76 will firmly engage the upper stud 69 while the U-slot 77 makes similar engagement with the lower stud. The tight fit at this point, and at two vertically spaced points, results in a rigid box structure without the need for diagonal bracing and independent of any front and back panels which may be then hung in place over the cross-bars without the use of any fasteners, since the basic structure has the necessary diagonal rigidity without the front and back panels.

The back panel 81 (see FIG. 4) has a flat center section 82, which, when the panel is installed, will be substantially flush with the center section 43 of the return flange 41 on the side panel. At its lower end, the back panel 81 has a construction similar to that of the side panel 11 and has a folded, lower edge 83 and a projecting lip 84 which, when the panel is in place, will rest on the top of the base 20. Along each edge, the center section 82 has an inwardly extending side flange 86 terminating in an outwardly extending lip 87, which is positioned to fit behind the Z-bar 44 to retain the panel against outward movement. Along the top edge, the panel 81 has an inwardly extending top flange 89 and a downwardly extending lip 91 which is arranged to fit over the cross-bar top flange 73 with the lip 91 on the inside of the center wall 72. From this construction of the back panel 81, it can be seen that when the cabinet is assembled with the end panels and cross-bars in place, the back panel 81 can be fitted by lowering it from the upper edge with the lips 87 being fitted behind the Z-bars to hold the panel in place. The back panel 81 is then lowered until the lip 84 abuts against the top of the base 20 and, at the same time, the top flange 89 will abut against the top flange 73 on cross-bar 71 so that the back panel 81 is held in place by the lips 87 and 91, and when the top 17 is fastened in place, it rests on the top flange 89 to prevent any vertical movement of the panel.

The front panel 12 (see FIGS. 5 and 6), which provides an opening closed by the doors 15, is mounted in a somewhat different manner from the back panel 81 and, rather than fitting flush with the end and center panels, is mounted to extend outwardly, and therefore has outer dimensions equal to the height and width of the cabinet excluding the legs 28. Accordingly, front panel 12 is in the form of a rectangular frame having a top member 97 and a bottom member 99 connected together by a pair of vertical side members 101. The side members 101 are mirror images of each other and, as shown in FIG. 5, are in the form of a hollow box having an inner side or face 102, a front face 103, an outer side 104, and a rear side 106 adapted to abut against the cabinet. Suitable hinge members 108 are preferably welded to the inner side 102 in a predetermined position to mount the doors in the desired position within the opening formed by the top, bottom, and side members.

The top member 97, which is welded to the two side members, has a front face 111 which is coplanar with the side member front face 103 extending upward to an inwardly extending top side 112 which terminates with a downwardly extending lip 113. Along its lower edge, the front side 111 is connected to a bottom side 114 forming the upper edge of the door opening, which in turn at its inner edge terminates in a downwardly extending lip 115 which provides a stop determining the closed position of the doors and also serving to mount any desired sort of catch for holding the doors in a closed position.

The bottom member 99, which is also welded to the side members 101, includes a front face 118 which is also coplanar with the side member front faces 103 which, along its upper edge, also has a top side 119 extending backward to a step 121 and rearwardly extending flange 122 to provide additional stiffness and a bottom stop for the doors. Along the lower edge, the bottom member has a bottom side 124 which extends rearwardly for a distance greater than the spacing of the edge of the flange 122 from the front face 118, where it terminates in an upwardly extending lip 126.

Figure 6:
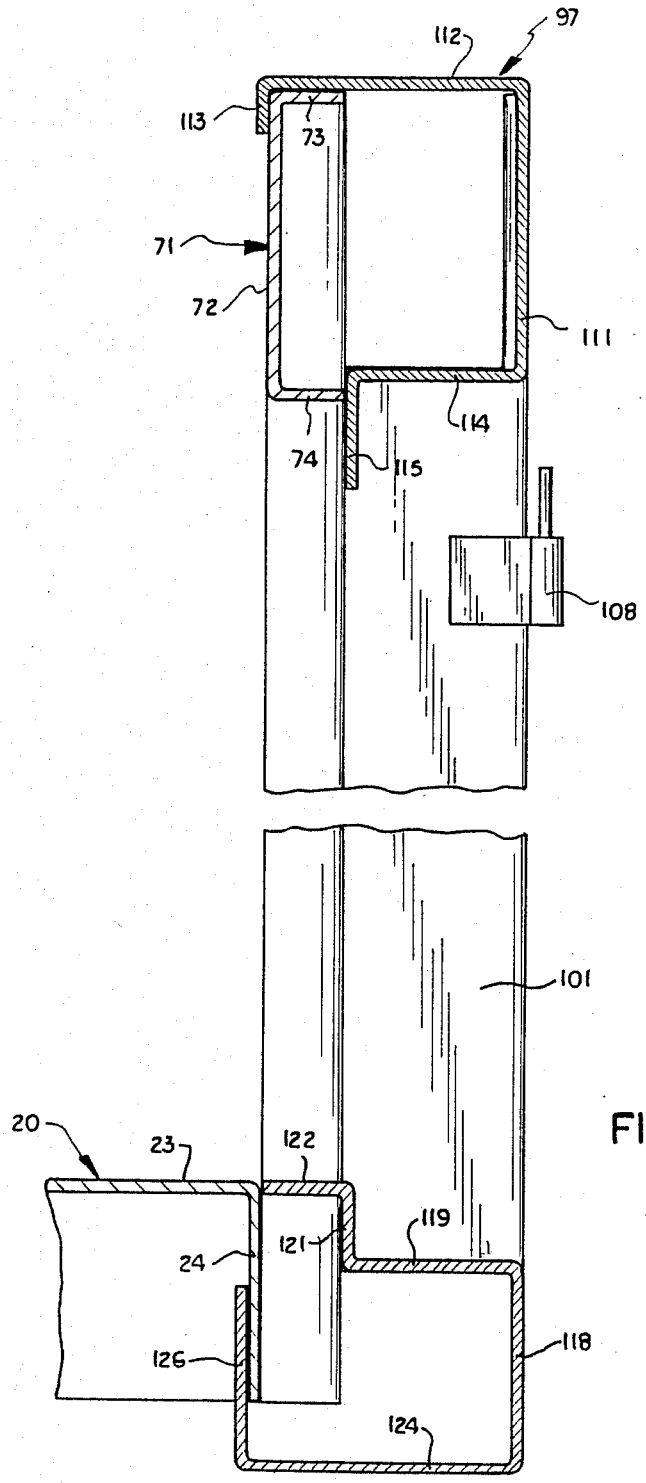
FIG. 6 is a vertical, cross-sectional view, taken on line 6—6 of FIG. 5.

As shown in FIGS. 5 and 6, the front panel 95 is easily mounted in place by first hooking the lip 126 beneath the downwardly extending flange 24 on the base 20 and then lifting the complete front panel 12 upwardly until the lip 113 can be hooked over the top flange 73 of cross-bar 71, after which the front panel 95 is lowered until the top side 112 rests on top of the top flange 73 and the flange 122 is level with the base center section 23. Because the vertical height of the lip 113 is much less than the vertical height of the lip 126, lip 126 still remains hooked behind the flange 24 so that the front panel is securely held in place along both the top and bottom edges. Again, when the top 17 is fastened to the unit, it engages the top side 112 of top member 97 and prevents any vertical movement which could allow the front panel to be disengaged from the rest of the cabinet assembly.

The steel counter can be shipped in a knock-down condition in a package that has a minimum volume, since the various panels can be stacked together, with each panel having only a minimal thickness determined by the various flanges and channels. The unit can be assembled quite quickly with only a few hand tools and with a minimum of instruction and a minimum number of fasteners required to complete the assembly.

The first step is to take the one base 20 and other bases 21 and attach the legs 28 by simply screwing them in place, with the stud 29 being threaded into the nut 27. After this is done, the bases can be placed on the floor, standing on the legs, and the various brackets 31 attached to each corner using a single screw 35. If two or more base units are employed in the finished cabinet construction, the bases are placed next to each other as shown in FIGS. 1 and 2. The next step is to assemble the end panels 11 and/or center panel 53 by placing them over the appropriate brackets, noting that when the center panel 53 is assembled to the adjacent brackets, the bases are connected together as a single unit. After these panels are in place, the screws 67, two for each bracket, are threaded in place to firmly hold the panels to the brackets. After this is done, the cross-bars 71, which are identical for front and back, are fitted over the studs 69 and then pushed downward toward the base to tie the side panels together in a rigid structure. The back panel can then be inserted as previously described by merely pressing it downward from the top until it is in fully assembled position, after which the front panel is then assembled, preferably without the doors, which can be hooked over the hinge members 108 as a final step. After the front and back panels are in place, the top 17 is placed on the assembly and the screws 55 fastened in place to lock the top panel to the rest of the structure. Then, after the doors are hung in place, the assembly is complete.

While what has been shown and described is a basic counter unit, it will be understood that the modular concept lends itself to other arrangements and additions. For example, shelf supports may be mounted along the Z-bars on the inside to receive clips for holding shelves in place, and vertical partitions may also be mounted within the cabinet. The top 17 need not be flat, and can be used as a mounting support for other devices, such as cup dispensers and additional shelving.

While the preferred embodiment of the invention has been shown and described in detail, it will be understood that various modifications and rearrangements may be made within the scope of the invention as defined in the following claims.

What is claimed is:

1. A knockdown metal cabinet comprising a flat rectangular base, said base having a center section and an integral flange extending downwardly along each edge of said center section, a bracket secured to each corner of said base at the front and rear flanges and extending upwards therefrom, each of said brackets being fastened to the base flange by a fastener and having a lip extending beneath the base flange, a pair of rectangular side panels extending upwards from and secured to opposite sides of said base, each of said side panels having a closed channel portion extending along each vertical edge and which telescopically receives and encloses the adjacent bracket, each side panel having a portion extending downwardly to cover said base flange and the enclosed brackets, fastener means extending through the inner side of each channel portion and the enclosed bracket to secure the side panel to said base, a pair of parallel horizontal cross-bars extending between opposing upper corners of said side panels, each cross-bar at each end being secured to the side panels at two vertically spaced points along the inner side of the closed channel portion, whereby said base, said side panels, and said cross-bars define a rigid rectangular boxlike structure, each of said side panels having an inwardly extending flange along the upper edge, a top extending over the upper surface of said cabinet, and means securing said top to said flanges on said side panels.

2. A knockdown metal cabinet as set forth in claim 1, including front and back panels each supported at its upper end on the adjacent cross-bar and extending laterally between said side panels and extending vertically between said top and said base.

3. A knockdown metal cabinet as set forth in claim 2, wherein said front panel comprises a top member, a bottom member, and a pair of side members secured together and defining a rectangular opening.

4. A knockdown metal cabinet as set forth in claim 3, wherein said top member has a flange which extends rearwardly to hook over the adjacent cross-bar.

5. A knockdown metal cabine as set forth in claim 4, wherein said bottom member has a flange which hooks underneath the base flange.

6. A knockdown metal cabinet comprising a pair of flat rectangular bases, each of said bases having a center section and an integral flange extending downwardly along each edge of said center section, said bases being positioned with adjacent side flanges in abutting contact, a bracket secured to each corner of each of said bases at the front and rear flanges and extending upwards therefrom, each of said brackets being fastened to the base flange by a fastener and having a lip extending beneath the base flange, a pair of rectangular side panels extending upwards from and secured to opposite outer sides of said bases, each of said side panels having a closed channel portion extending along each vertical edge and which telescopically receives and encloses the adjacent bracket, each side panel having a portion extending downwardly to cover said base flange and the enclosed brackets, fastener means extending through the inner side of each channel portion and the enclosed bracket to secure the side panel to said base, a center panel having a pair of closed channel portions extending along each vertical side, said pair of channel portions receiving and enclosing the adjacent brackets of both of said bases to secure said bases together as a unit, fastener means extending through each of said pair of channel portions and the enclosed bracket to secure the panel to said bases, a horizontal cross-bar extending between opposing upper corners of said side panels and said center panel, each cross-bar at each end being secured to a side panel and the center panel at two vertically spaced points along the inner side of the closed channel portion, whereby said bases, said side panels, said center panel, and said cross-bars define a rigid rectangular boxlike structure, each of said side panels having an inwardly extending flange along the upper edge, a top extending over the upper surface of said cabinet, and means securing said top to said flanges on said side panels.

7. A knockdown metal cabinet as set forth in claim 6, wherein said pair of closed channel portions on said center panel are formed on the outer side by a single channel member having a center portion spanning both of the adjacent brackets and inturned side portions extending toward the rear of the cabinet.

* * * * *